US005845416A

United States Patent [19]

Hands

[11] Patent Number: 5,845,416

[45] Date of Patent: Dec. 8, 1998

[54] TRANSPARENT SHOE COVER

[76] Inventor: Rhonda B. Hands, 1153 Prospect Ave., Toledo, Ohio 43606

[21] Appl. No.: 640,536

[22] Filed: May 2, 1996

[51] Int. Cl.[6] ..... A43B 3/18

[52] U.S. Cl. ..... 36/2 R; 36/7.2; 36/105; 36/7.4

[58] Field of Search ..... 36/90, 2 R, 7.1 R, 36/7.2, 7.4, 8.1, 97, 105

[56] References Cited

U.S. PATENT DOCUMENTS

| | | | |
|---|---|---|---|
| 1,604,954 | 11/1926 | Artz | 36/7.1 R |
| 1,621,153 | 3/1927 | Bunnenberg | 36/2 X |
| 1,827,423 | 10/1931 | Draikin | 36/2 R |
| 1,871,576 | 8/1932 | Argard | 36/72 R |
| 2,163,423 | 6/1939 | Crichton | 36/2 R |
| 2,420,618 | 5/1947 | Rabinovitz | 36/2 R |
| 2,438,308 | 3/1948 | Wheaton | 36/2 R |
| 2,657,477 | 11/1953 | Winslow | 36/72 X |
| 3,250,025 | 5/1966 | Crescent | 36/72 R |
| 4,451,995 | 6/1984 | Antonious | 36/51 |
| 4,713,895 | 12/1987 | Vallieres | 36/7.1 X |
| 4,847,934 | 7/1989 | Weber . | |
| 4,969,277 | 11/1990 | Williams | 36/97 |
| 5,165,182 | 11/1990 | Michael . | |
| 5,272,822 | 12/1993 | Diaz . | |

FOREIGN PATENT DOCUMENTS

| | | | |
|---|---|---|---|
| 15294 | 6/1911 | United Kingdom | 36/2 R |

*Primary Examiner*—Ted Kavanaugh

[57] ABSTRACT

The Transparent Shoe Cover is an open soled or partially open soled cover for boots, dress shoes, and most particularly sport shoes. The shoe cover provides a temporary and transferable see through protective shield to preserve the attractive appearance, enhance the wear life, and further the life span of costly footwear.

The cover generally includes a durable, transparent material which covers the partial sole, outer sole, upper and side portions of the shoe. A toe hold is utilized to hold the cover in place at the toe portion of the shoes. Additionally, an adaptable retention is utilized near the heel or rear instep of the shoe to hold the cover onto the shoe and prevent slipping of the cover during normal activity or movement by the wearer. The adaptable retention provides the stretch and adaptability necessary to enable the shoe cover to fit a wide range of shoe shapes and sizes. The shoe cover leaves the majority of the sole open, thereby, enabling the wearer to utilize the traction portion of the actual shoe's sole.

1 Claim, 5 Drawing Sheets

TRANSPARENT SHOE COVER

FIELD OF INVENTION

This invention relates to an adaptable open or partially open soled shoe cover for protecting the uppers and outer soles of shoes.

BACKGROUND—DISCUSSION OF PRIOR ART

The cost of footwear is relatively high and continues to rise. Individuals who are continuously on their feet require the orthopedic support and extended wear life of specific styles and do not wish to damage their shoes and ruin them prematurely. This is particularly true in industrial situations where grease, dirt, welding slag, or other materials or compounds can contact and damage the uppers and outer soles of the shoe. Previously shoe covers were developed to protect shoes in adverse weather conditions, to protect the wearer from physical harm, and/or to insure sanitary conditions in laboratories and hospitals.

Shoe covers have been designed to protect shoes in adverse weather conditions. They are constructed of pliable weather resistant fabrics, such as leather, vinyl, and nylon. They cover the shoe and obstruct viewing of the style, color, design, and type of shoe of the wearer. These shoe covers are essentially of a standard design and are available in neutral colors.

Dress shoe covers for shoe protection in adverse weather conditions have limited market potential. Designed and marketed to and for an elite group of consumers, such as executives and business people, they are utilized mainly in adverse weather conditions or seasonally, in the winter and spring. The mass consumer market comprised of service people and industrial workers have little need and/or use of such products.

Today's consumers of footwear opts to invest in a particular shoe not only for comfort features but with an eye towards fashion. The trend of foot apparel in the American marketplace is towards style, design, brand name, and expense. Footwear is representative of an individual's particular taste, economic status, and view towards fashion. These trends hinder and decrease the likelihood of one opting to wear a protective shoe garment which detracts from or blindly covers the shoe.

Adaptable shoe covers are utilized mainly in hospital or clean room settings. Adaptability of these shoe covers is achieved by utilizing fully stretched strips of elastic sewn directly into the material. This results in an unsightly bulging of fabric, what is termed a "gathering of material". Adaptable shoe covers are unsightly and conceal the wearer's individual unique taste, style, color, and design of foot apparel. In addition, many adaptable clean room shoe covers are disposable; thereby fragile because they are intended for one time usage.

Young or old, rich or poor, today's consumers are opting to invest in costly footwear, particularly athletic shoes. There exists a need to provide a means of protecting and preserving the appearance and comfort of the shoe of the wearer's choice.

Prior Art Shoe Protectors Comprised of Materials that Conceal the Shoe U.S. Pat. No. 4,604,816 to Davison (1984) discloses a gaiter rand to be applied to boots with a sole and a heel. The gaiter is comprised of a flexible upper portion. The rand is comprised of an elastic material with the periphery adapted for connection to the flexible upper portion.

Diaz discloses a protective cover for shoes, boots and like in U.S. Pat. 5,172,493 (1991). It protects feet, boots, or shoes and is comprised of a multiple layer of fabric.

A heel protector is disclosed in U.S. Pat. No. 5,361,517 to Liener (1993). The cover has an open toe design and a wrap that maintains the cover on the heel of the shoe.

U.S. Pat. No. 4,825,563 to Strongwater (1987) is for a shoe protector. It is comprised of a front and rear protecting means with heel and toe holds and stretchable right or left side protecting means to provide adaptability.

U.S. Pat. No. 5,251,386 to Diaz (1991) for a protective cover for shoes, boots, and the like is an adaptable cover for chainsaw use.

Vallieres has U.S. Pat. No. 4,713,895 (1986) for a sports shoe cover. It is described as a protective gaiter for sport shoes, particularly running shoes. It is comprised of two flexible sheets of material covering the upper and heel portion of the shoe, the ankle, and lower calf of the wearer. A hook and pile fastener tape is in spaced apart areas about the periphery of the sole of the shoe and to the lower margin of the heel and upper portion of the material. The fasteners are to inhibit flapping of the gaiter during running. Ventilation openings are provided between the spaced apart tapes along the sole.

A water resistant boot for athletic footwear is depicted in U.S. Pat. No. 4,896,438 to DeBease (1988). It is a water resistant shell that cradles the athletic shoe. The upper sleeve portion surrounds the ankle. This sleeve has an opening for shoe insertion. A water resistant base is attached to engage the sole of the shoe. Elastic retainer means around the ankle forces the shell against the shoe to minimize slippage between the boot and shoe cover. There is also a fastening means for securing the sleeve portion about the ankle and to enhance holding.

Adaptable Shoe Covers utilizing elastic gathering of material U.S. Pat. No. 4,616,428 to Leger (1985), U.S. Pat. No. 4,616,429 to Alcala (1984), and U.S. Pat. No. 4,918,839 to Brandon (1988) are for adaptable shoe covers comprised of sheets of material united along weld lines. They all have soles and utilize strips of elastic gathered into the material.

Edgerton discloses a sole-less shoe top cover in U.S. Pat. No. 4,665,633 (1986). It has a depending band from the toe to the instep with elastic cords. The depending band utilizes stitching and gathering of material.

U.S. Pat. No. 5,165,182 is to Michael (1990) for an open-ended shoe cover is made of a generally tubular section with a leg and foot portion. It has an open top and an open bottom end. There is a retention means at the top end for leg retaining. The open bottom end defines a toe and heel portion separated by an opposing side portion. An elastic retainment means about the periphery of the open bottom retains the bottom end above the periphery of the shoe exposing a portion of the sole. An attachment means is used on the heel above the elastic retainment means to attach the heel of the cover to the shoe.

OBJECTS AND ADVANTAGES

The Transparent Shoe Cover Succeeds Where Others Fail.

The Transparent Shoe Cover is useful as a protective shoe shield capable of enhancing the wear life, preserving the appearance, and furthering the life span of costly footwear. But most outstandingly, while protecting the shoe it simultaneously allows the wearer to display the unique style, design, brand name, and color of one's footwear choice.

The clear plastic composition and design of this shoe cover results in the ability of the wearer to cover and protect his shoe yet continue to display and express individual taste, style, and expense of the shoe. The Transparent Shoe Cover is style enhancing, therefore, much more likely to be worn. The clear design does not distract from the quality, selection, expense, or brand name of the shoe the consumer has opt to purchase. Optional fabrics such as denim, vinyl, and leather are available for the less style conscientious shoe cover wearer or for the industrial worker with heavy duty shoe protection needs.

Outstanding Marketability

The Transparent Shoe Cover's potential market class is the general working class population. There exists a need and much demand for a device or method to preserve the attractiveness, cleanliness, value, and wear life of costly footwear.\

Methods such as shoe saver sprays, wiping, washing, and even limiting the wear and usage of these shoes have little success. None of these measures actually prolong the attractive appearance nor the actual wear life of the shoe. The working masses, in industry and the service sector, need a shoe cover that is not only appropriate for use in climatic weather conditions, but is appropriate for use in grungy work conditions.

The Transparent Shoe Cover provides an inexpensive and easily used means of preserving and protecting costly footwear in a variety of less than ideal environment, whether working, playing, or merely walking. The Transparent Shoe Cover is most efficiently utilized in dry yet dirty, dusty, or messy indoor or outdoor conditions. It can also be used in damp or moist environments. It is light weight and easy to use. The Transparent Shoe Cover ia appropriate for year round use by working adults, as well as school age children.

Adaptable Retention Means

The Transparent Shoe Cover is adaptable and has no bulgy gathering of material. It derives its adaptability from an adaptable retention means. The adaptable retention means is affixed to the cover's outer length, rather than sewn fully stretched into the material of the cover. This process eliminates unsightly bulging created by the gathering of material process of adaptability. The adaptable retention means provides the stretchability which enables the cover to form fit a range of shoe styles and sizes. Preferably located on the heel of the shoe cover, the adaptable retention means may also be located at the toe or on the side portion(s) of the shoe cover.

It would be an advantage to have an open soled shoe cover that is a temporary and transferable cover which may be adapted to fit various sizes and styles of athletic, work, or orthopedic shoes. The Transparent Shoe Cover is capable of prolonging and preserving the attractiveness and life span of shoes by shielding the shoes from grease, dirt, chemicals and various other spills encountered in a vairety of environments.

DRAWING FIGURES

The above, as well as other advantages of the present invention will become readily apparent to those skilled in the art, from the following detailed description when considered in light of the accompanying drawings.

In the drawings, closely related figures have the same number but different alphabetic suffixes.

REFERENCE NUMERALS

20 clear plastic shield
21 toe hold
21A binding
22 toe reinforcement
24 adaptable retention means
26A fastening mechanism
26B fastening attachment
28 strip attachment tape

DESCRIPTION FIG. 1A

Figure 1A:
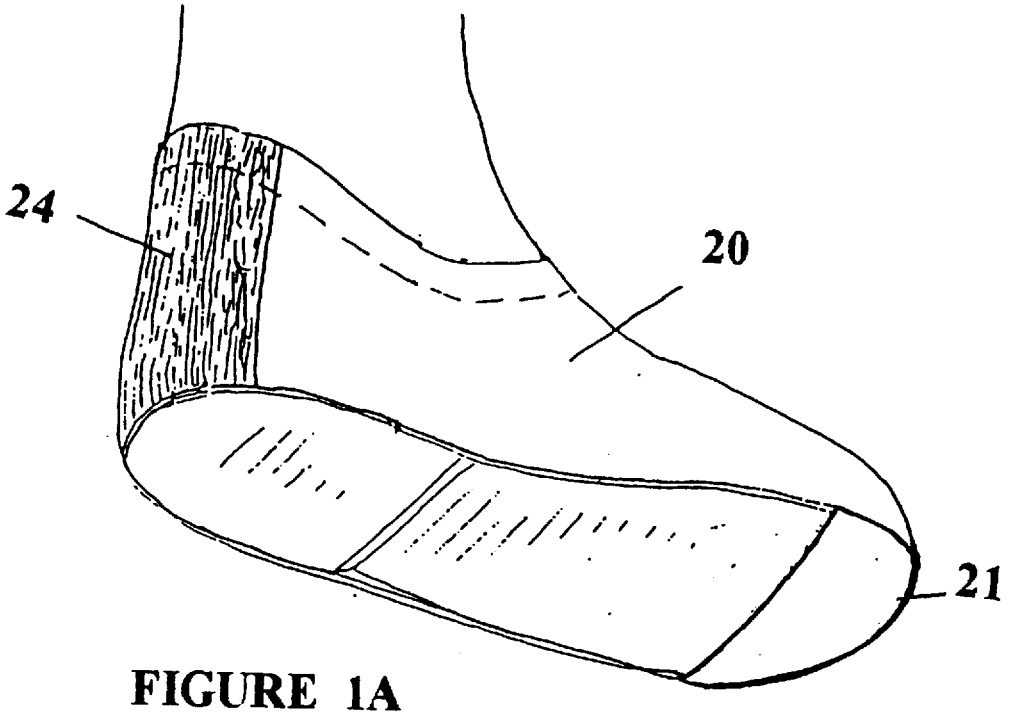
FIG. 1A is a perspective view of a basic version of a partially soled pull over shoe cover.

A basic version of a pull over shoe cover is illustrated in FIG. 1A. A shield or cover comprised of a single sheet of clear plastic (20) covers the upper, sides, toe, and partial sole portions of the shoe. Clear plastic shield (20) extends from the partial sole to the toe portion of the cover upwards and rearwards covering the upper, inner and outer side portions of the shoe. Clear plastic shield (20) has two outer lengths. The sizing of clear plastic shield (20) may be tailored to enable use of the cover with either low cut or high top footwear. The shield is preferably made of clear plastic but may also be comprised of denim, leather, vinyl, or any pliable fabric or material. Optionally, the shield may be made with a chemical resistant material suitable for use in harsh work environments.

A toe hold or partial sole (21) extends partly over the front toe portion of the bottom sole of the shoe. Toe hold (21) is comprised of plastic but may also be comprised of rubber, vinyl, elastic or any stretchable or durable material. Alternately, the toe hold may be tapered or omitted to provide a totally exposed sole.

A adaptable retention means (24) is adjoined to the outer lengths of the inner and outer side portions of clear plastic shield (20). Adaptable retention means (24) comprises the heel of the shoe cover. Adaptable retention means (24) is comprised of elastic, spandex, rubber or any stretchable or expandable fabric or material.

DESCRIPTION FIG. 1B

Figure 1B:
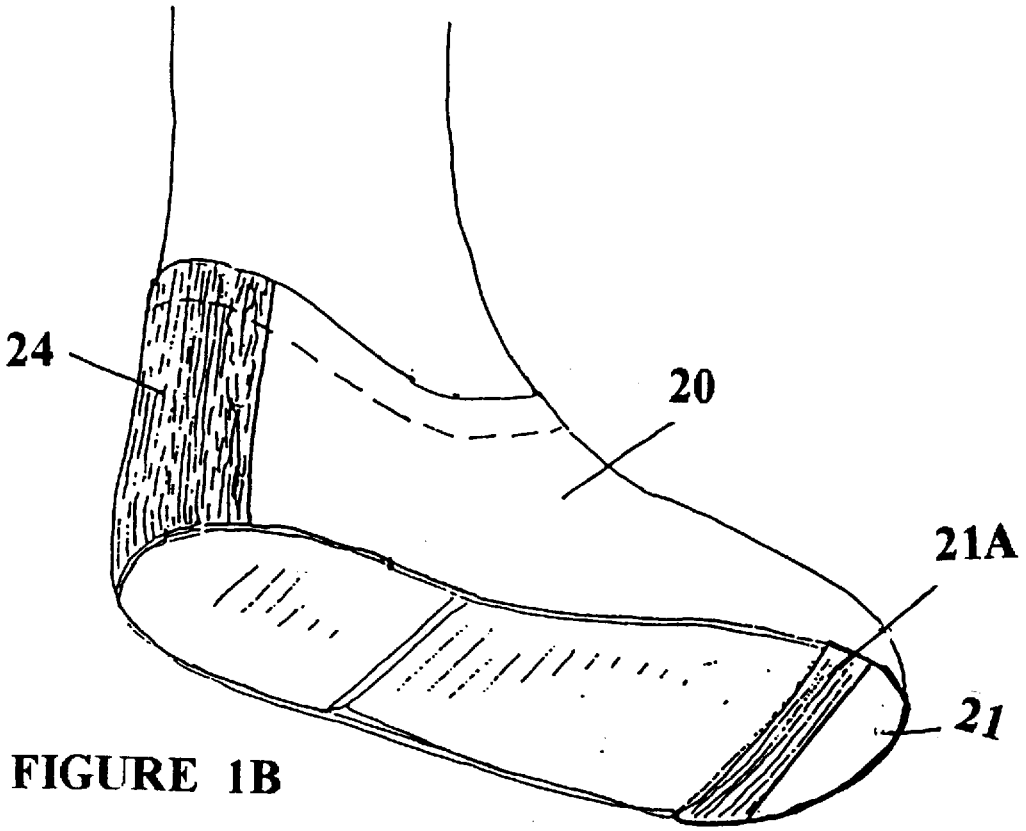
FIG. 1B is a perspective view of a pull over shoe cover with binding.

A pull over shoe cover with binding of toe hold (21) is illustrated in FIG. 1B. A shield or cover comprised of a single sheet of clear plastic (20) covers the partial sole, toe, upper and side portions of the shoe.

Toe hold (21) of clear plastic shield (20) is at the toe portion of the shoe cover. A binding (21A) generally constructed of an elastic band is stretched across the bottom of the sole of the shoe, adjoining the toe hold. Binding (21A) may be comprised of rubber, vinyl, plastic, elastic, or any stretchable or durable material. Alternately, toe hold (21) may be tapered in conjunction with binding or be omitted.

Adaptable retention means (24) comprise the heel portion of the shoe cover.

OPERATION FIGS. 1A and 1B

The transparent shoe cover utilizes a single sheet of a durable plastic material, clear plastic shield (20), to cover the shoe. The material must conform to the shape of the shoe. The clear plastic shield (20) is predetermined to cover the toe, the toe hold, and the forward portion of the shoe and extends backward to cover the side portions of the shoe. Clear plastic permits visibility of the shoe while the cover is in place. The cover is capable of being washed or cleaned so that it may be used over an extended period of time.

Toe hold (21) enables securement of the front toe portion of the shoe cover onto the shoe without additional attachment means. Binding (21A) provides flexibility, strength, tension, and additional durability to the toe hold portion of the shoe cover.

As illustrated in FIGS. 1A and 1B the cover is detachable from the shoe with a securing means in the toe portion (21 & 21A) and an adaptable retention means (24). The elastic composition of the adaptable retention means provides both stretchability and tension necessary to allow the shoe cover to neatly conform a wide range of differently sized and shaped shoes.

Adaptable retention means (24) is generally an elastic band positioned about the heel or rear instep for final placement of the cover onto the shoe. Adaptable retention means (24) functions are to provide adaptability to the shoe cover enabling one size to fit a range of shoe sizes and widths, to provide tension to the plastic shield portion of the shoe cover forcing it to snugly conform to the individual style and shape of the wearer's shoe, and to provide stronger more durable protection to the heel portion of the shoe cover for activities such as driving a car. The elasticity of the adaptable retention means (24) stretches the cover over the uppers and sides of the shoe to provide a form fit. The form fit is necessary to prevent slipping of the cover during normal walking and use by the wearer.

For application of the partially soled pull over shoe cover, the shoe is inserted through the opening at the top of the shoe cover; toe portion first. Insert toe of the shoe between toe hold (21) and/or binding (21A) and clear plastic shield (20). After insertion of the toe portion of the shoe; stretch adaptable retention means (24) backward and up over the heel portion of the shoe. When the cover is placed over a shoe, the upper portion of the shoe is covered and protected. The shoe cover leaves the majority of the shoe's sole open thereby enabling the wearer to utilize the traction portion of the shoe's sole.

DESCRIPTION FIG. 2A

Figure 2A:
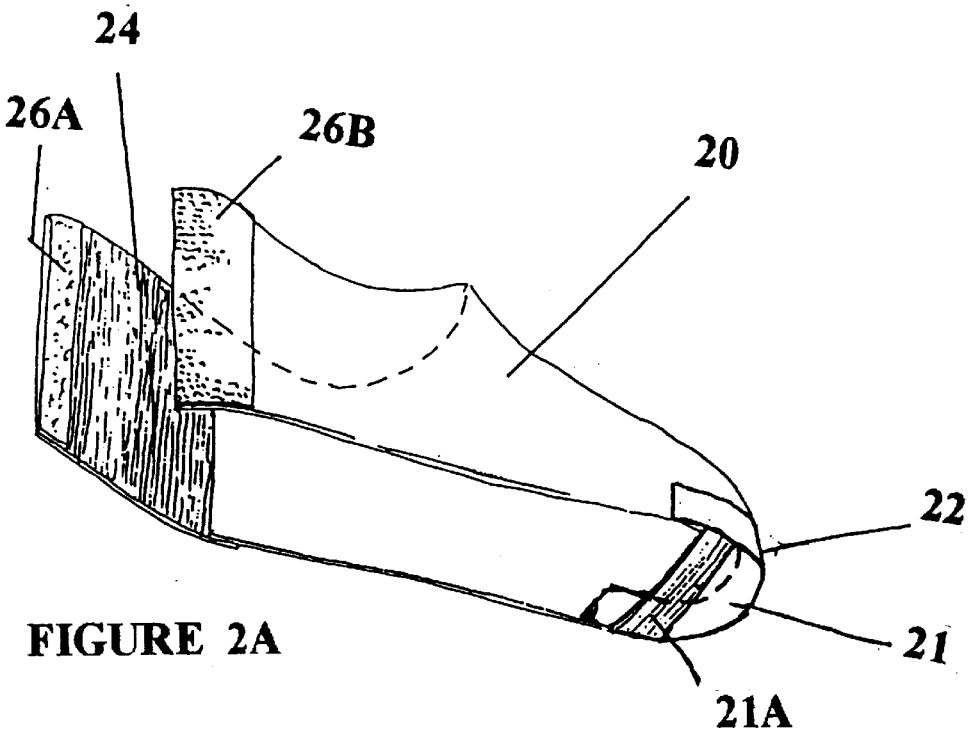
FIG. 2A is a partially soled detachable shoe cover with toe reinforcement.

A partially soled detachable shoe cover with reinforcement is shown in FIG. 2A. A toe reinforcement (22) is affixed to the shoe cover's upper sole toe portion. Toe reinforcement (22) spans around the entire front toe portion of the shoe cover. Depending on the type of shoe cover and its intended usage, toe reinforcement (22) may span various lengths of the shoe cover's upper outer sole wholly or in part. Toe reinforcement (22) is comprised of a pliable, durable material preferably the soft cloth portion of a hook and loop fastener, but may also be made of rubber, elastic, or other material. Toe reinforcement (22) is affixed onto the inside toe portion of clear plastic shield (20).

Toe hold (21) is adjoined to binding (21A). Detachable adaptable retention means (24) is shown in the open position. One end of adaptable retention means (24) is adjoined to outer length of clear plastic shield (20). The other end of adaptable retention means (24) has a fastening mechanism (26A) affixed to it outer length. Fastening mechanism (26A) is preferably comprised of hook and loop fasteners; but may also be snaps, buttons, zippers or other fastening means. A fastening attachment (26B) compatible to fastening mechanism (26A) is affixed to the outer length of the opposing side portion of clear plastic shield (20).

DESCRIPTION FIG. 2B

Figure 2B:
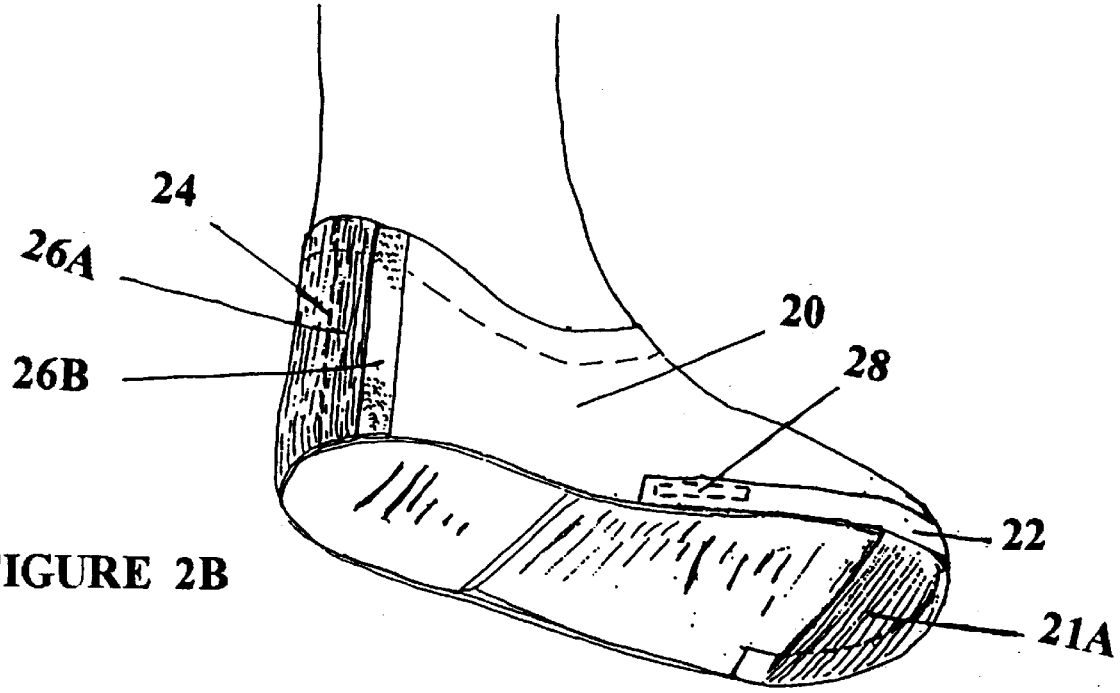
FIG. 2B is a partially soled detachable shoe cover with binding and extended toe reinforcement.

A partially soled detachable shoe cover with binding (21A) and extended toe reinforcement (22) is depicted in FIG. 2B. Clear plastic shield (20) is attached to toe reinforcement (22). Toe reinforcement (22) spans from the outer sole, outer side toe portion of the shoe cover around the front of the toe and rearward along the inner side portion to the instep. Toe reinforcement (22) is capable of being detachably secured to the shoe by use of a strip attachment tape (28). For optional detachable securement of toe reinforcement (22) by use of strip attachment tape (28), wearer must adhesively affix strip attachment tape (28) to shoe.

Toe hold (21) of clear plastic shield (20) is virtually eliminated in this version of the shoe cover. Binding (21A) fully covers the toe hold portion. Binding (21A) is adjoined to clear plastic shield (20) at the toe portion of the shoe cover. Binding (21A) shown here as an elastic band is partly stretched across the front portion of the bottom sole of the shoe. The binding is permanently connected to the outer edges of the clear plastic shield. Detachable adaptable retention means (24) is shown in the closed position over a shoe. Sole of the shoe is available to wearer for traction.

OPERATION FIGS. 2A and 2B

In FIGS. 2A and 2B the partially open soled detachable shoe cover is comprised of clear plastic shield (20) with toe reinforcement (22). Toe reinforcement 922) provides strength and durability to the toe portion of the shoe cover. Toe reinforcement (22) is comprised of soft cloth portion of hook and loop fastener. Toe reinforcement (22) is capable of being detachably secured to toe and/or instep portion of the shoe by use of strip attachment tape (28). Detachable securement of toe reinforcement (22) by use of strip attachment tape (28) is optional and recommended for heavy to maximum activity usage of the shoe cover to further ensure securement of the cover to the wearer's shoe.

Adaptable retention means (24) is detachable. One side of adaptable retention means (24) is permanently adjoined to clear plastic shield (20). The other side of adaptable retention means (24) has fastening mechanism (26A) affixed to its outer length. Compatible fastening attachment (26B) is affixed to outer length of opposite side portion of clear plastic shield (20).

To apply shoe cover, first insert toe portion of shoe between clear plastic shield (20) and toe hold (21 and/or 21A). Detachable adaptable retention means (24) is wrapped rearward around side portions of the shoe and secured at the heel by use of fastening mechanism (26A) and fastening attachment (26B).

For optional detachable securement of toe reinforcement (22) by use of strip attachment tape (28); first adhesively affix strip attachment tape (28) to toe and/or instep portion of wearer's shoe. Shoe cover is detachably secured onto shoe by first inserting toe portion of shoe between toe hold (21 and/or 21A) and toe portion of clear plastic shield (20) thereby affixing toe reinforcement (22) to strip attachment tape (28) located on toe and/or instep portion of the shoe. Detachable adaptable retention means (24) is wrapped rearward around side portions of the shoe and secured at the heel by use of fastening mechanism (26A) and fastening attachment (26B).

Figure 3A:
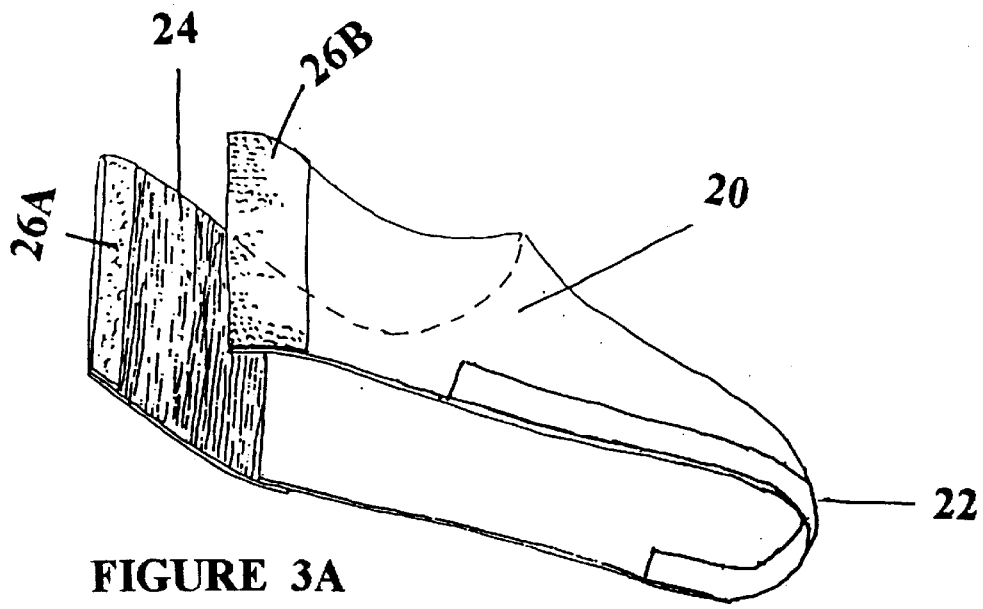
FIGS. 3A and 3B shows a perspective view of a detachable sole less shoe cover.
Figure 3B:
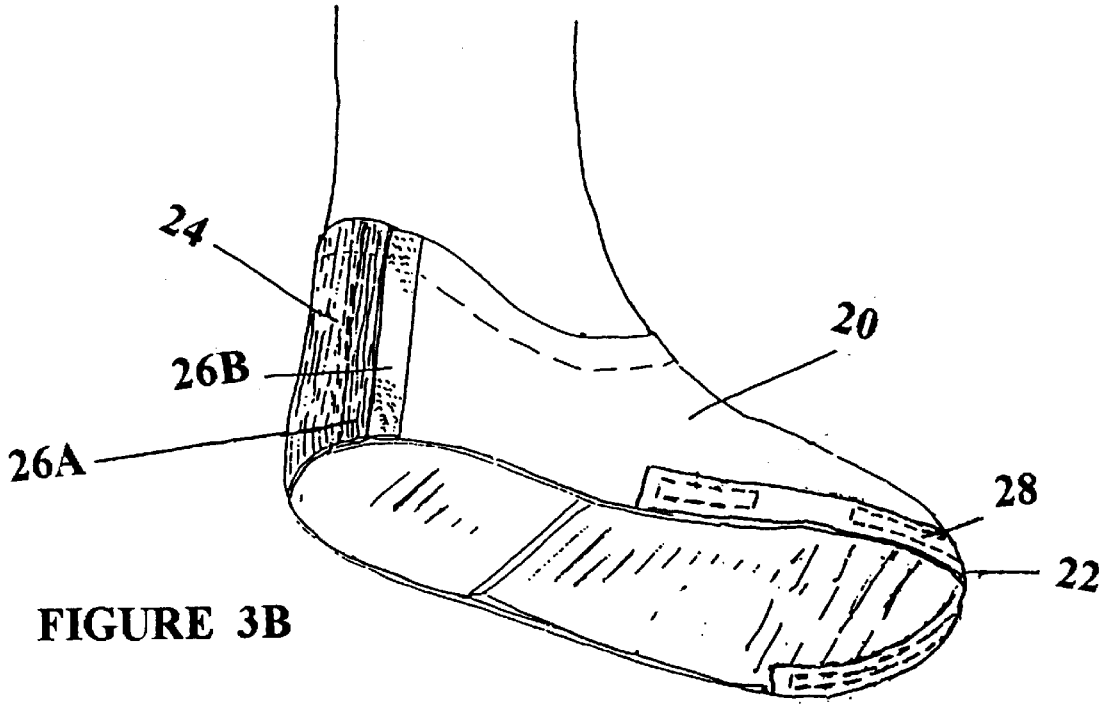

DESCRIPTION FIGS. 3A and 3B

FIGS. 3A and 3B shows a sole less shoe cover with detachable adaptable retention means (24). Clear plastic shield (20) is affixed to toe reinforcement (22). As depicted here toe reinforcement (22) spans from the outer toe section of the shoe cover around the front of the toe and rearwardly along the inner side portion to the instep. Detachable adaptable retention means (24) is shown in the open position in FIG. 3A.

FIG. 3B shows a sole less shoe cover with detachable adaptable retention means (24) in the closed position over a shoe. Toe reinforcement (22) is attached to clear plastic shield (20). Toe reinforcement (22) is comprised of soft cloth portion of hook and loop fastener and is detachably secured onto strip attachment tape (28).

Adaptable retention means (24) is detachably secured via fastening mechanism (26A) and fastening attachment (26B) around the heel portion of the shoe. Sole of the shoe is totally exposed and available for use by the wearer.

OPERATIONS FIGS. 3A and 3B

In FIGS. 3A and 3B toe reinforcement (22) is comprised of soft cloth portion of hook and loop fastener. Toe reinforcement (22) is capable of being detachably secured to toe portion of the shoe by use of strip attachment tape (28). Strip attachment tape (28) is adhesively affixed to toe and instep portion of the wearer's shoe. Shoe cover is detachably secured onto shoe by first aligning and affixing toe reinforcement (22) to strip attachment tape (28) located on toe and instep portions of shoe. Press instep portion onto instep strip attachment tape (28) to engage.

Detachable adaptable retention means (24) is wrapped rearward around side portions of shoe and secured at the heel by use of fastening mechanism (26A) and fastening attachment (26B).

Figure 4:
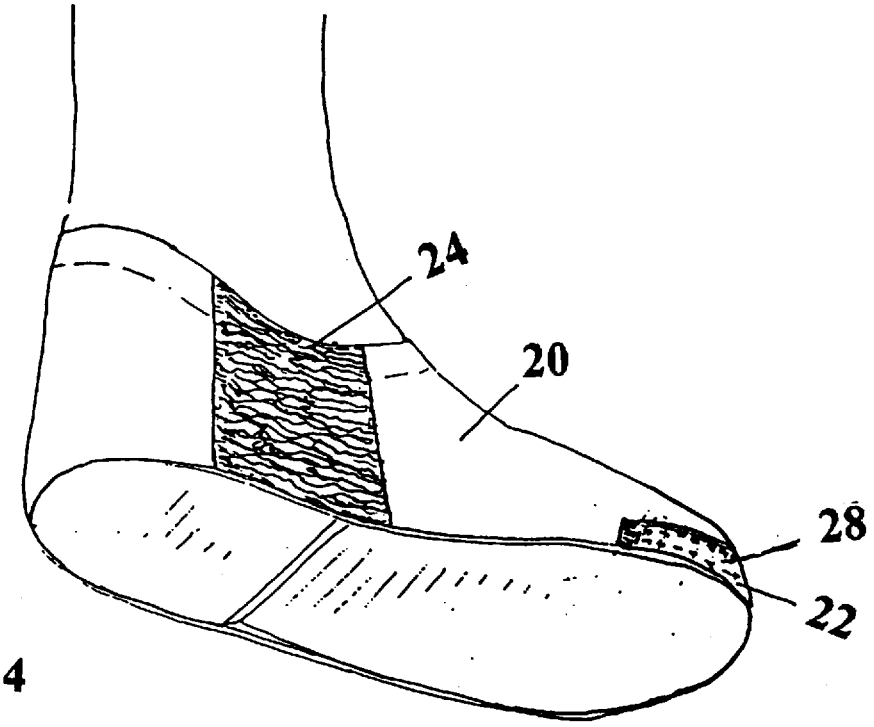
FIGS. 4 and 5 shows a shoe cover with side adaptability means.
Figure 5:
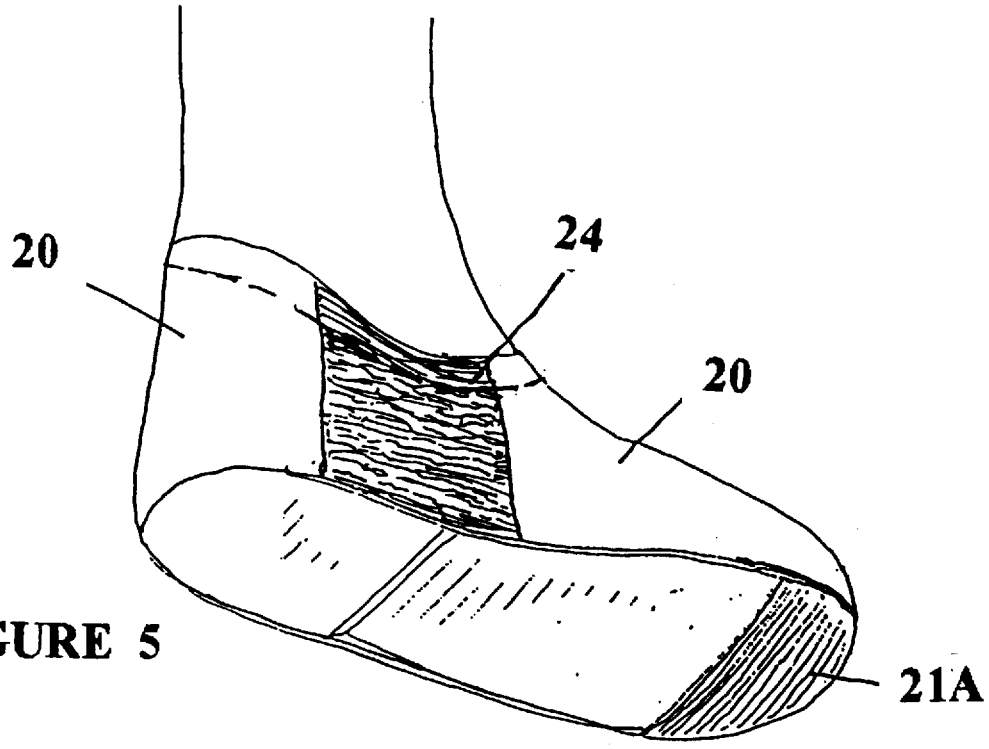
Figure 6:
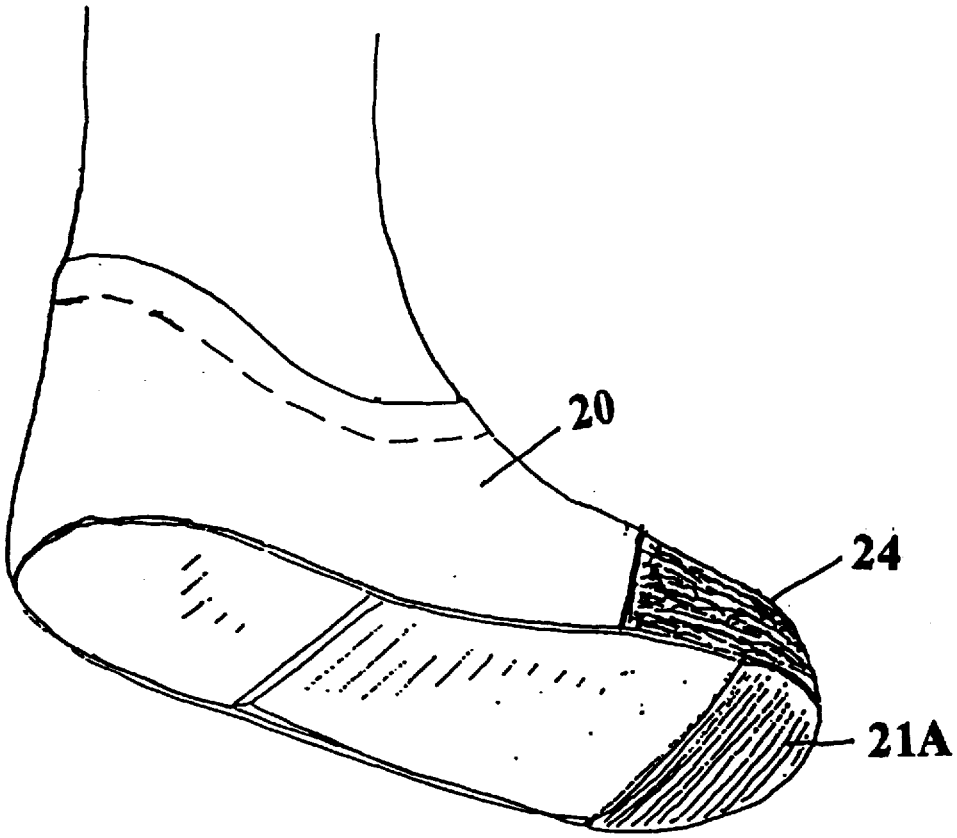
FIG. 6 shows a shoe cover with toe and/or upper portion means of adapting.

DESCRIPTION FIGS. 4 thru 6

Additional embodiments of The Transparent Shoe Cover are shown in FIGS. 4, 5, and 6. In FIGS. 4 and 5 adaptable retention means (24) is affixed to clear plastic shield (20) at the side portion(s) of the shoe cover either detachably or permanently. Adaptable retention means (24) may be located on the inner, outer, or on both side portions of the shoe cover. FIG. 4 is representative of an open soled shoe cover with side adaptable retention means (24). FIG. 5 shows a partial sole shoe cover with side adaptable retention means (24).

A partial sole shoe cover with adaptable retention means (24) at the toe and/or uppers portion is illustrated in FIG. 6.

SUMMARY, RAMIFICATIONS, AND SCOPE OF INVENTION

Thus the reader will see that The Transparent Shoe Cover provides a light weight, easy to use, visually appealing method of preserving the appearance and extending the wear life of costly footwear useful to men, women, and children during work or play. The Transparent Shoe Cover is useful as a protective shoe shield capable of enhancing the wear life, preserving the appearance, and furthering the life span of costly footwear. While protecting the shoe it simultaneously allows the wearer to display the unique style, design, brand name, and color of one's footwear choice.

The clear plastic composition and design of this shoe cover results in the ability of the wearer to cover and protect his shoe yet continue to display and express individual taste, style, and expense of the shoe. The Transparent Shoe Cover is style enhancing, therefore, much more likely to be worn. The clear design does not distract from the quality, selection, expense, or brand name of the shoe the consumer has opt to purchase. There exists a need and much demand for a device or method to preserve the attractiveness, cleanliness, value and wear life of costly footwear.

The working masses in industry and the service sector need a shoe cover that is not only approriate for use in climatic weather conditions; but also in grungy work invironments. The Transparent Shoe Cover provides and inexpensive and easily used means of preserving and protecting costly footwear in a variety of less than ideal environments, whether working, playing, or merely walking. The Transparent Shoe Cover is most efficiently utilized in dry yet dirty, dusty, or otherwise messy indoor or outdoor conditions. It can also be used in damp or moist environments. It is light weight and easy to use. The Transparent Shoe Cover is adaptable and has no bulgy gathering of material. It derives its adaptabilitiy from the adaptable retention means. The adaptable retention means is affixed to the cover's outer length, rather than sewn, fully stretched into the material of the cover. This process eliminates unsightly bulging created by the gathering of material process of adaptability.

It would be an advantage to have a transparent shoe cover that is a temporary and transferable cover which may be adapted to fit various sizes and styles of athletic, work, and orthopedic shoes. The Transparent Shoe Cover is capable of prolonging and preserving the attractive appearance and wear life of shoes by shielding the shoes from grease, dirt, chemicals, and various other spills encountered in a variety of settings.

While my above description contains many specifications, these should not be construed as limitations on the scope of the invention, but rather as an exemplification of one preferred embodiment thereof. Many other variations are possible. For example, a shoe cover comprised of pliable rubber utilizing the adaptable retention means at the heel, toe, or on the side portion(s) to provide adaptability to a range of shoe shapes and sizes. Or a detachable two piece shoe cover of transparent design with adaptable strip attachment means.

Accordingly, the scope of the invention should be determined not by the imbodiments illustrated, but by the appended claims and their legal equivalents.

I claim:

1. A shoe cover for sport shoes, said shoe cover comprising:

a single shield of durable, pliable, transparent material, said shield consisting essentially of two outer side portions, a toe portion and a toe hold which extends below a front sole portion of the shoe for securing the toe portion of the shoe cover onto the shoe;

an elastic band attached between a rear portion of the two outer side portions, said elastic band stretches to allow the cover to provide a snug fit over the upper and sides of the shoe and to enable the cover to fit a range of shoe sizes and widths;

a detachable toe reinforcement attached to an inside of the shield, wherein the toe reinforcement is a narrow strip that runs from one outer side portion to the other outer side portion, said detachable toe reinforcement is detachable to the shoe cover by a strip of tape;

whereby said shoe cover covers the upper and sides of the shoe and leaves a majority of the bottom of the shoe sole of the sports shoe exposed.

* * * * *